United States Patent [19]

Ratajski

[11] 4,198,811

[45] Apr. 22, 1980

[54] WATERTIGHT WATCHCASE HAVING A REMOVABLE POLYGONAL HARD GLASS

[75] Inventor: Michel P. Ratajski, Bienne, Switzerland

[73] Assignee: Montres Rado S.A., Switzerland

[21] Appl. No.: 43,683

[22] Filed: May 30, 1979

[30] Foreign Application Priority Data

Jun. 2, 1978 [CH] Switzerland ..... 6093/78

[51] Int. Cl.[2] ..... G04B 37/08

[52] U.S. Cl. ..... 368/292; 368/294

[58] Field of Search ..... 58/88 R, 90 R, 91, 105, 58/127 B

[56] References Cited

U.S. PATENT DOCUMENTS

| | | | |
|---|---|---|---|
| 3,505,807 | 4/1970 | Piquerez | 58/90 R |
| 3,750,388 | 8/1973 | Piquerez | 58/91 |

FOREIGN PATENT DOCUMENTS

| | | | |
|---|---|---|---|
| 2111931 | 11/1971 | Fed. Rep. of Germany | 58/88 R |

*Primary Examiner*—J. V. Truhe
*Assistant Examiner*—Leonard W. Pojunas, Jr.
*Attorney, Agent, or Firm*—Stevens, Davis, Miller & Mosher

[57] ABSTRACT

The polygonal flat glass 1*a* stretches itself out to the edge of the watchcase except on two diametrically opposed sides, where it is held between portions 3 by cylindrical pins 6 clamped within through holes formed by two semicylindrical grooves 7, 8 provided in the metallic case section and in the glass, respectively. The glass 1*a* and the pins 6 are held transversely in place by the pressure which gaskets 10, 11 exert on the glass. Rough walls of grooves 7, 8 and pins softer than the metallic case section and the glass increase the clamping action of gaskets 10, 11. An opaque mask formed under a peripheral glass area hides gasket 11 and the upper face of the spacing ring 14. The glass sides secured to the middle case section 2*a* could also be curvilinear.

6 Claims, 8 Drawing Figures

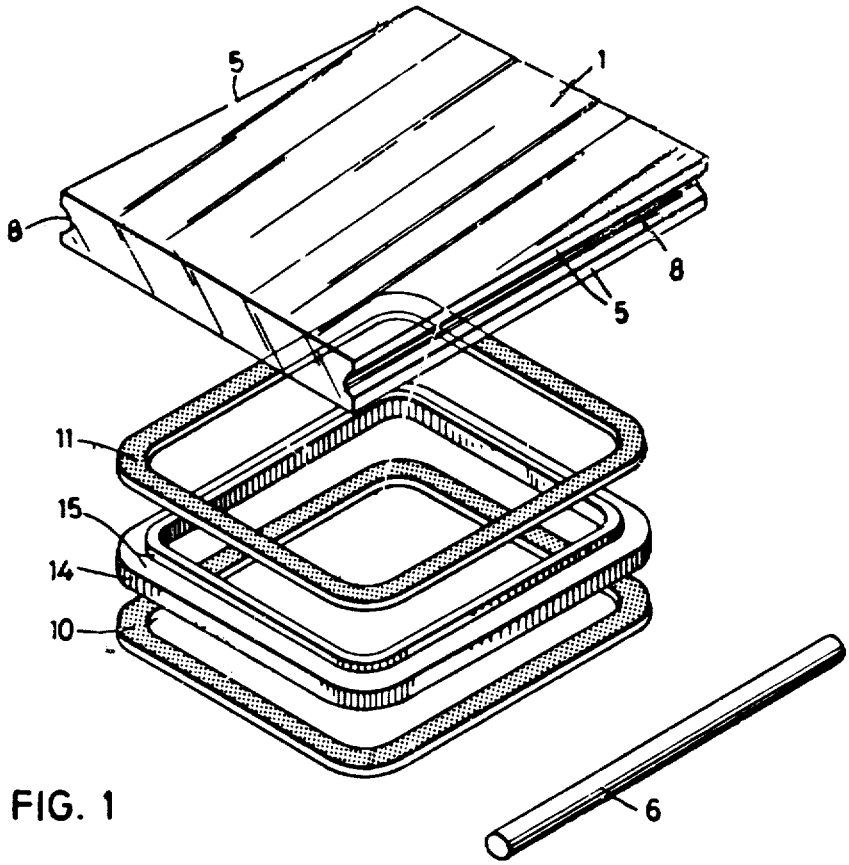
FIG. 1
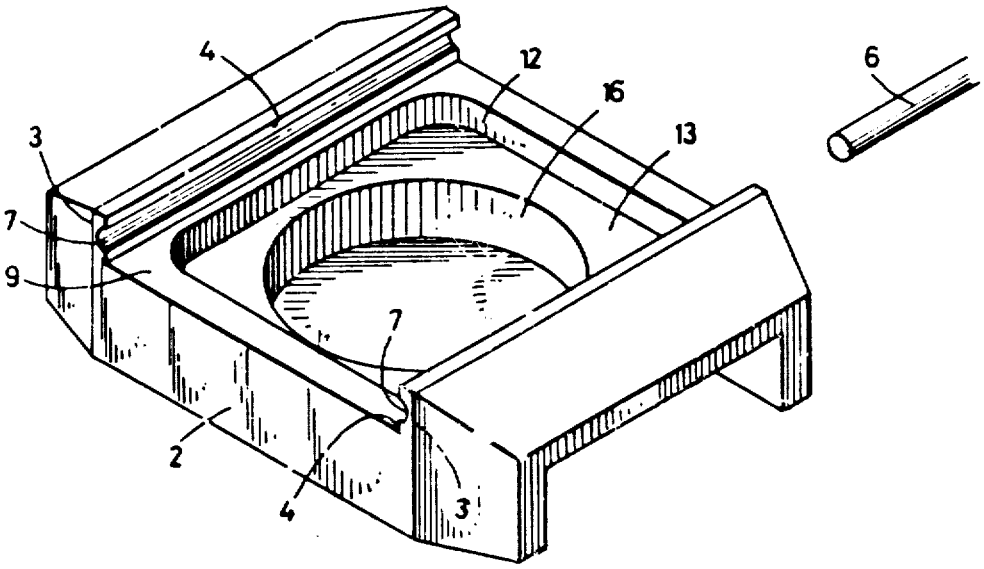

WATERTIGHT WATCHCASE HAVING A REMOVABLE POLYGONAL HARD GLASS

This invention relates to watertight watchcases, especially to watertight cases for wristwatches, having a removable polygonal hard glass.

Nowadays, the watchcases often comprise a mineral (tempered) glass or a glass consisting of an aluminium oxide crystal (sapphire). However, as opposed to the organic glasses which are bulged, the hard glasses are flat. Thus with shaped watchcases the necessity soon arose for the sake of aesthetics to extend the glass as far as possible toward the watchcase periphery, i.e. to reduce to a minimum the metallic watchcase portions appearing around the glass.

It could be observed that a polygonal flat glass which would have only two diametrically opposed sides set between upward projections of the middle case section, while the other glass sides would be flush with the periphery of the middle case section, would produce a watch with a nice appearance.

However, removably securing a hard glass to the middle case section under these conditions sets a problem which the known glass fixing means do not solve satisfactorily.

The invention now proposes glass fixing means which solve that problem in a safe manner without a substantial increase of the costs for manufacturing and assembling the necessary parts.

According to the invention the middle case section has at its periphery portions which project upwards on two diametrically opposed glass sides, while the other glass sides may extend outwards so as to be flush with the periphery of the middle case section; the glass is safely held, axially and laterally, between these case portions by means of keying members which are caused by a watertight gasket located under the glass and compressed thereby to be clamped between inner rims of said case portions and outer glass rims.

If the case portions holding the glass are provided opposite the wristband attaching lugs, they do not disturb the aesthetic effect of the watch. On the contrary, they form a nice transition between the proper casing enclosing the watch movement and the wristband, so that said casing appears as entirely covered by the glass.

Many further advantages of the solution according to the invention will appear in the course of the following description.

Two embodiments and some modifications thereof are now disclosed by way of example with reference to the accompanying drawings in which:

FIG. 1 is a diagrammatic exploded perspective view of the first embodiment;

Figure 2:
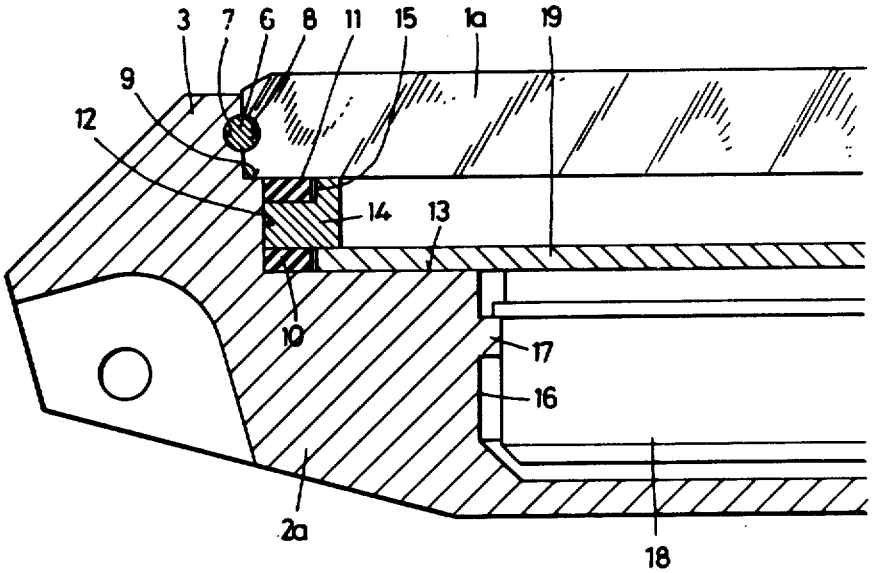
FIG. 2 is a part-sectional view on a larger scale of a first modification.

FIG. 1 illustrates how the rectangular glass 1 is secured on the metallic middle case section 2. It is namely located between two upwards projecting portions 3 of section 2. Each portion 3 has a flat inner wall 4 which is parallel to the watchcase axis. The gap between walls 4 is substantially equal to the width of glass 1 so that the diametrically opposed side faces 5 of the latter and walls 4 adjoin each other once the glass 1 has been set in place. Said gap is, however, adjusted in such manner to the glass width, that glass 1 may freely be inserted between walls 4. The length of glass 1 is equal to the width of the middle case section 2. Portions 3 are thus facing the glass 1 over their whole length.

The glass 1 is secured between portions 3 by means of two cylindrical pins 6 constituting keying members. For that purpose, pins 6 are inserted into cylindrical through holes 7, 8 formed by semicylindrical grooves 7 provided in walls 4 and by semicylindrical grooves 8 provided in the corresponding glass side faces 5, grooves 7 and 8 extending over the whole width of the watchcase. At their ends holes 7, 8 thus opens on the side faces of the watchcase. The diameter of holes 7, 8 is adjusted with sliding fit to the pins 6 so that the latter may freely be inserted into said holes, when the semicylindrical grooves 7 and 8 are located exactly opposite each other. This is the case when glass 1 stands in abutting engagement with the upper peripheral flat face 9 of section 2. Pins 6 have a length equal to the width of the watchcase, so that their ends are flush with the side faces of section 2. Pins 6 may be cut at the exact length either before or after they are set in place.

An inopportune shifting of pins 6 within holes 7, 8 or of the glass 1 between walls 4 is prevented by means of watertight gaskets 10, 11 located in a recess 12 of section 2 and exerting a strong axial pressure on the glass 1. Gasket 10 lies on the flat bottom face 13 of recess 12. A metallic spacing ring 14 is set on gasket 10. A recess 15 is formed in ring 14 for accommodating gasket 11.

Section 2 is still provided with a cylindrical opening 16 for accommodating the watch movement.

With respect to FIG. 1 being only a diagrammatic showing, FIG. 2 represents an elaborate watchcase, in which section 2*a* is made integral with the watchcase bottom 28. An annular rim 17 projecting inwards from the cylindrical wall of opening 16 forms a rest for the movement 18 of the watch. The dial 19, having a shape similar to that of the glass 1*a*, protrudes the watch movement 18. It extends on the flat bottom face of recess 12. Gasket 10 is located in the free space between the wall of recess 12 and the dial edge. Its thickness exceeds that of the dial. The spacing ring 14 has a height almost equal to the distance between the dial 19 and the glass 1*a*. The thickness of gasket 11 also exceeds the depth of recess 15 of ring 14.

With the watchcase of FIG. 2, the watch movement is set in place from the dial side of its casing. Once the movement 18 together with the dial 19 have been set in place, the gaskets 10, 11 together with the ring 14 been located around and above the dial 19 and the glass 1*a* been placed on gasket 11 between portions 3 of section 2*a*, the spacing ring does not lie on the dial 19 and the glass 1*a* stands some distance apart from face 9, due to the sizes of gaskets 10 and 11. In order to bring ring almost onto dial 19 and glass 1*a* into abutting engagement with face 9 for inserting pins 6 into holes 7, 8, an external axial pressure must be exerted on glass 1*a* thus strongly compressing gaskets 10 and 11. Once the pins 6 are fully introduced into holes 7, 8, the external pressure on the glass 1*a* is released. The pressure which the gaskets 10 and 11 then exert on the glass 1*a* causes the pins 6 to be strongly clamped between the inwardly projecting rims 29 formed at the upper edge of portions 3 by grooves 7 and the outwardly projecting rims 30 formed at the lower edge of the corresponding glass side faces by grooves 8. That clamping action prevents both the pins 6 from moving in axial direction with respect to rims 29 and 30 and the glass 1*a* from inopportunely being shifted aside between portions 3 of section 2*a*.

That clamping action can still be reinforced in a particularly advantageous manner by making pins 6 out of a material being softer than those of section 2*a* and of glass 1*a* and by machining grooves 7, 8 so that the faces of rims 29, 30 engaging pins 6 have a rough surface finish. Under these circumstances the pressure exerted on the glass by gaskets 10, 11 causes the small asperities due to the roughness of rims 29, 30 to be stuck into the pins 6, thus anchoring the latter together with the glass 1*a* to the metallic case section 2*a*.

To open the watchcase disclosed, the glass 1*a* must firstly be pressed until it lies on face 9, in order that the grooves 7, 8 come to stand exactly opposite each other. The pins 6 can then be removed from holes 7, 8 thus completely releasing the glass 1*a* which can then be removed from the middle case section 2*a*, thus giving access to the watch movement.

Figure 3:
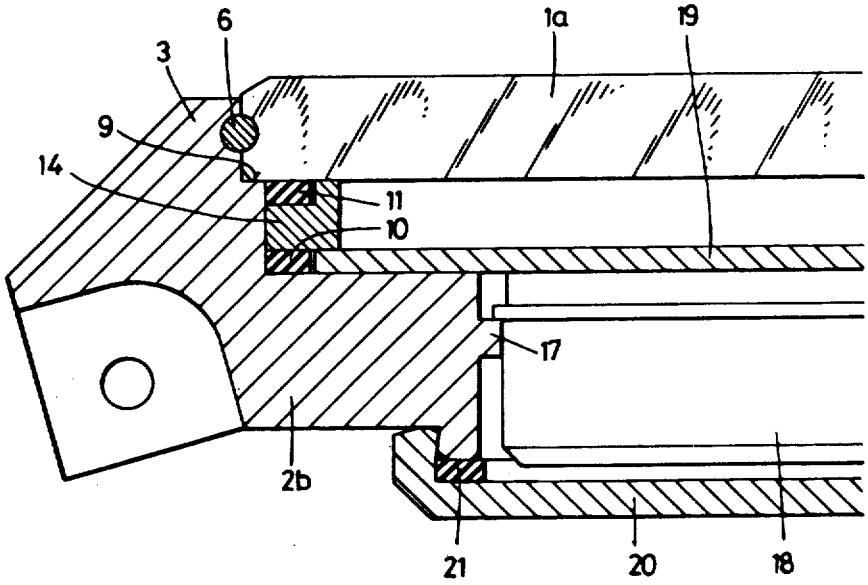
FIG. 3 is a sectional view similar to that of FIG. 2 showing a second modification.

The modification represented in FIG. 3 only differs from that of FIG. 2 by the presence of a removable circular bottom 20 snap-fitted to the middle case section 2*b* with interposition of a watertight gasket 21. This removable bottom has the advantage to give an easy access to the movement for some correction or adjustment which can be made without taking the movement out of the watchcase. The removable bottom can also enable a quick change of the battery in the case of an electronic watch.

The invention is not limited to watchcases into which the movement is mounted from the glass side. The glass fixing means according to the invention can also be useful and advantageous with watchcases into which the movement is mounted from the bottom side.

Figure 4:
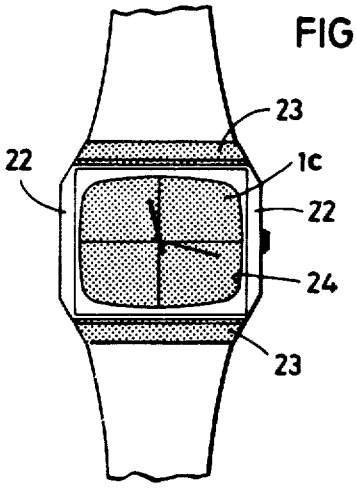
FIGS. 4 through 6 are plan views on a reduced scale, each showing a further modification.

In the modification of FIG. 4 the small sides of the glass 1*c*, which are flush with the side face of the watchcase, are chamfered as shown at 22, in order to match with the upper inclined faces 23 of the upwards projecting portions of the middle case section. Moreover, it appears in FIG. 4 that the lower glass face carries a mask 24 preferably formed by a metallization and which extends from the glass periphery inwards so far as to hide the upper face of the spacing ring located between the dial and the glass. Such a mask is, of course, also provided in the examples previously disclosed.

Figure 5:
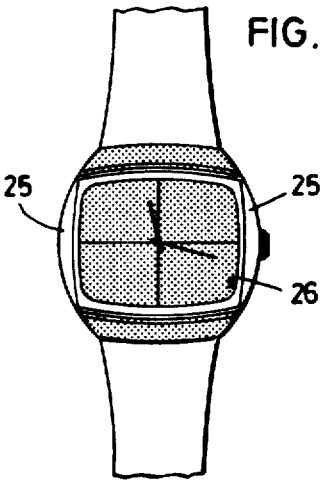
Figure 6:
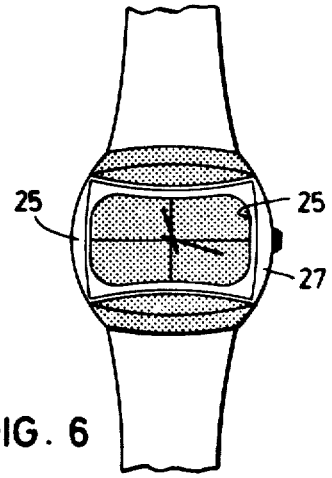

Whereas the glass sides engaged between upwards projecting portions of the middle case section were rectilinear in the example previously described, they are curvilinear in the modifications represented in FIGS. 5 and 6. In FIG. 5 they are convex and in FIG. 6 concave. With these two modifications the glass is laterally held in place by virtue of its shape. Its small sides are also flush with the watchcase and they are chamfered at 25 to match with the shape of the upper faces of the middle section upward projections. Finally, the lower glass face also carries a mask 26, 27 having an inner contour equal to that of the spacing ring inserted between the dial and the glass.

The disclosure of the first embodiment has shown that the sole parts of the configuration of the adjoining faces of the glass and of the upwardly projecting portions of the middle case section, which contribute to the glass fixation, are the rims 29 and 30. Forming these rims as disclosed in the first embodiment has the advantage that the glass can be set in place by approaching therewith the middle case section along the watchcase axis.

Figure 7:
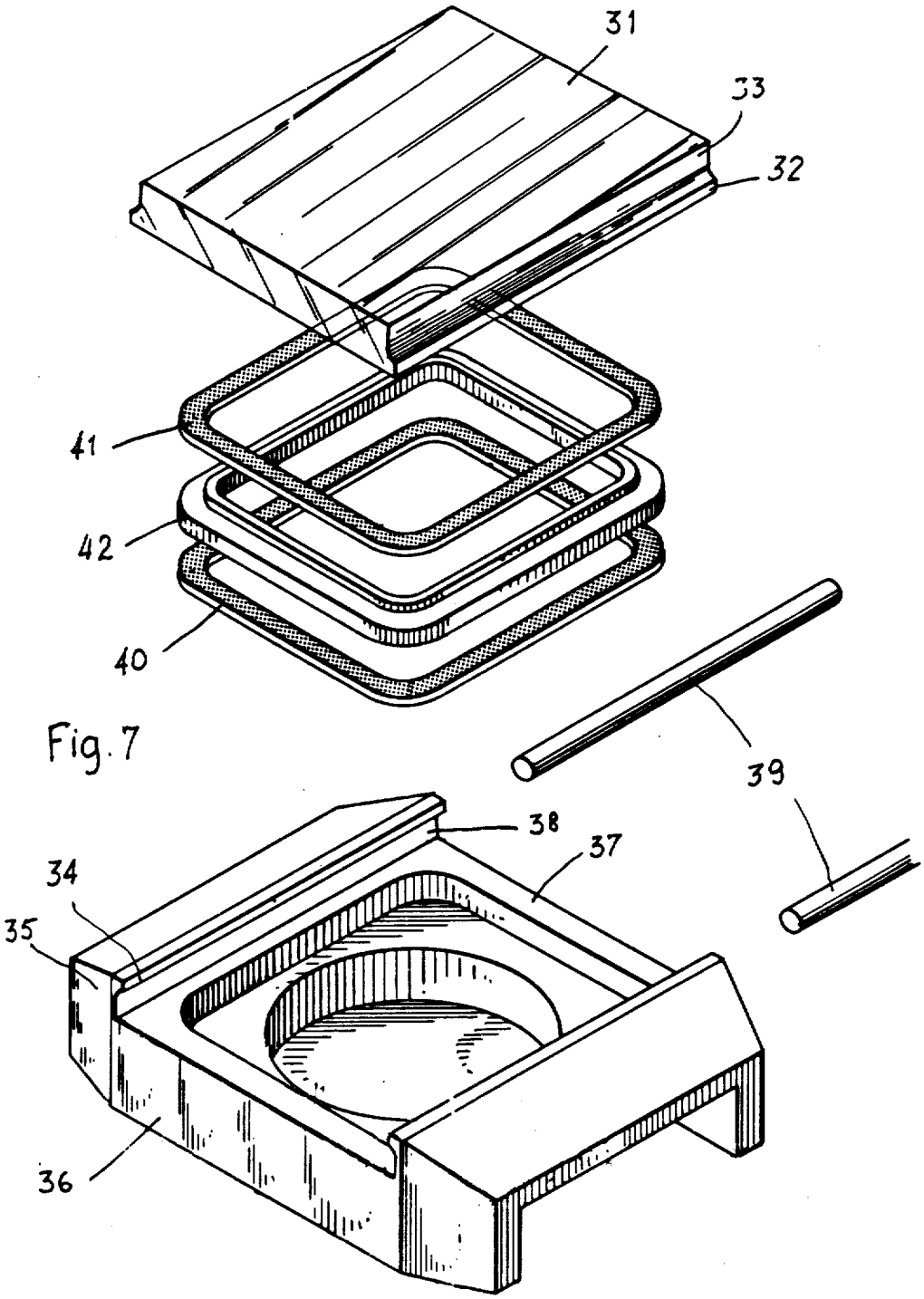
FIG. 7 is a diagrammatic exploded perspective view similar to that of FIG. 1, showing the second embodiment.
Figure 8:
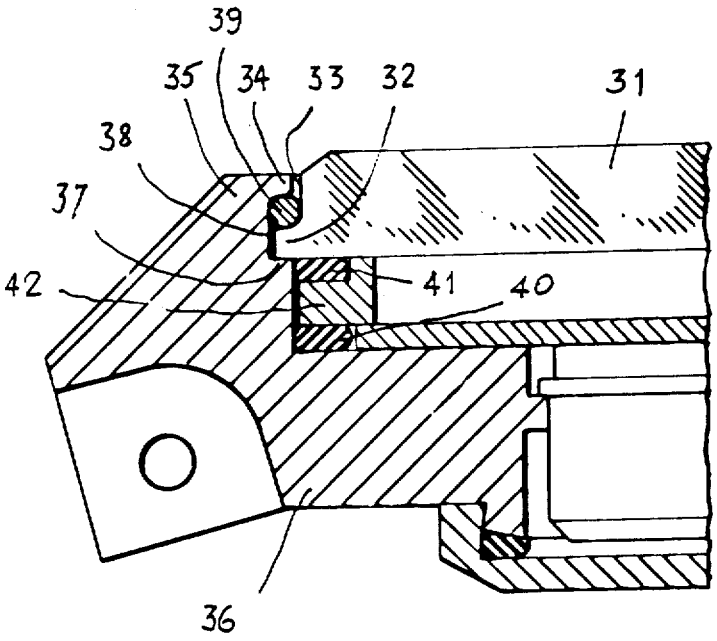
FIG. 8 is a sectional view thereof similar to those of FIGS. 2 and 3.

In some instances and for certain reasons it may, however, be more advantageous to provide the opposite faces of the glass and of the case portions with the sole rims engaged by the keying members as shown in the second embodiment (FIGS. 7 and 8). In this case the glass 31 has a single rim 32 projecting outwards from the lower edge of each one of the faces 33 of its long sides. The inwardly projecting rims 34 of portions 35 of the middle case section 36 are at such a distance from each other that the side faces 33 of the glass 31 takes place with a free play therebetween. Portions 35 are hollowed out between rims 34 and the flat face 37 of the middle case section as shown at 38, in order to receive the glass rims 32 and the glass fixing pins 39. When the glass 31 lies on the flat face 37, the gap between rims 32 and 34 is wide enough to permit freely inserting pins 39 therebetween. The same arrangement of watertight gaskets 40, 41 and spacing ring 42 as in the first embodiment is located under the glass 31.

To set the glass in place, rims 32 are shifted transversely under rims 34 until the short side faces of the glass are flush with the side faces of section 36. This handling is easy because the width of the gap between gasket 41 and rims 34 is substantially larger than the thickness of rims 32. Once the glass 31 has been set in the correct transverse position, it is pressed downwards until it lies in abutting engagement with the flat face 37 while strongly compressing the gaskets 40 and 41. In that position the pins 39 can smoothly be inserted between rims 32 and 34, where they will be strongly clamped after release of the external pressure on the glass 31.

In a modification (not shown) this clamping action is increased by substituting key members with a rectangular or square cross-section for the cylindrical pins 39 and by machining flat faces on rims 32 and 34 for engaging these key members.

It will be observed with the watchcase according to the invention that the glass can be set in place while avoiding any transverse displacement which could damage the gasket with which it must cooperate for sealing the watchcase. The glass frictionally engages that gasket only when it is pressed downwards for mounting the key members.

The arrangement of two thin gaskets between the glass and the middle case section instead of a single one has the advantage of producing a strong axial pressure on the glass without stressing the gaskets beyond their limit of elasticity and without producing a substantial deformation of these gaskets. Therefore, the spacing ring can be made with a great opening and the dial accordingly be larger than with a single gasket.

Finally, the compression of the gaskets is limited by the thickness of the dial and the depth of the recess of the spacing ring, respectively.

I claim

1. In a watertight watchcase having a removable polygonal hard glass, in combination: a middle case section having a peripheral upper flat face covered by the glass and portions at its periphery projecting upwards beyond said flat face and adjoining the glass side faces on two diametrically opposed glass sides, each one of said glass side faces having at its lower edge an outwardly projecting rim, said outer portions of the middle case section having at their upper edge an inwardly projecting rim; a watertight gasket located under the glass, and keying members clamped between the inwardly projecting rims of said outer portions of the middle case section and said outwardly projecting rims of the glass under the action of said gasket being frictionally engaged and compressed by the glass, thereby firmly securing said glass and said keying members to the middle case section.

2. In a watertight watchcase according to claim 1, said glass being adjusted with only a small free play between the inwardly projecting rims of said outer portions of the middle case section.

3. In a watertight watchcase according to claim 2, said outwardly projecting glass rims being formed by semicylindrical grooves provided in the glass side faces on said diametrically opposed glass sides, said inwardly projecting rims of the outer portions of the middle case section being similarly formed by semicylindrical grooves provided in the faces adjoining the glass of said outer portions, said grooves in the glass and said grooves in the outer portions of said middle case section forming cylindrical through holes extending across the whole watchcase when said glass stands in abutting engagment with said peripheral upper flat face of the middle case section, and said keying members consisting of cylindrical pins smoothly insertable into said cylindrical holes.

4. In a watertight watchcase according to claim 2, said outwardly projecting glass rims being the sole glass parts projecting outwards from said diametrically opposed glass side faces, said outer portions of the middle case section being hollowed below said inwardly projecting rims for receiving said glass rims and said keying members.

5. In a watertight watchcase according to either claim 3 or claim 4, a recess having a flat bottom face being formed in said upper flat face of the middle case section for receiving a watch dial, a spacing ring located in said recess being inserted between said dial and said glass, said watertight gasket being located in a recess of said spacing ring, and a further watertight gasket being located around said dial below said spacing ring, said further watertight gasket being pressed by said spacing ring against the flat bottom face of said recess.

6. In a watertight watchcase according to claim 1, the material of said keying members being softer than those of said middle case section and said glass, the faces of said rims engaging said keying members having a rough surface finish.

* * * * *